US009841257B2

(12) United States Patent
Dees

(10) Patent No.: US 9,841,257 B2
(45) Date of Patent: Dec. 12, 2017

(54) DUAL PICTURE SIGHTS

(71) Applicant: John Dees, Germantown, MD (US)

(72) Inventor: John Dees, Germantown, MD (US)

( * ) Notice: Subject to any disclaimer, the term of this patent is extended or adjusted under 35 U.S.C. 154(b) by 0 days.

(21) Appl. No.: 15/471,791

(22) Filed: Mar. 28, 2017

(65) Prior Publication Data

US 2017/0276455 A1 Sep. 28, 2017

Related U.S. Application Data

(60) Provisional application No. 62/390,387, filed on Mar. 28, 2016.

(51) Int. Cl.

| | |
|---|---|
| ***F41A 15/00*** | (2006.01) |
| ***F41G 1/01*** | (2006.01) |
| ***F41G 1/02*** | (2006.01) |
| ***F41G 1/08*** | (2006.01) |
| ***F41G 1/10*** | (2006.01) |

(52) U.S. Cl.
CPC ..... *F41G 1/01* (2013.01); *F41G 1/02* (2013.01); *F41G 1/08* (2013.01); *F41G 1/10* (2013.01)

(58) Field of Classification Search
CPC ..... F41G 1/02; F41G 1/06; F41G 1/42
USPC ..... 42/111, 141
See application file for complete search history.

(56) References Cited

U.S. PATENT DOCUMENTS

| | | | | |
|---|---|---|---|---|
| 8,015,744 | B1 * | 9/2011 | Swan | F41G 1/065 42/133 |
| D666,689 | S * | 9/2012 | Swan | F41G 1/065 D22/109 |
| 9,328,993 | B1 * | 5/2016 | Heacock | F41G 1/02 |
| 2014/0173965 | A1 * | 6/2014 | Kennedy | F41G 1/01 42/135 |

OTHER PUBLICATIONS

Jeff Johnson, XS Ghost Ring Hunter Sights, Jan. 7, 2011, American Hunter, pp. 1-3.

* cited by examiner

*Primary Examiner* — J. Woodow Eldred
(74) *Attorney, Agent, or Firm* — Stein IP, LLC

(57) ABSTRACT

The invention relates to a uniquely designed set of iron sights for a firearm. The rear site includes a ring aperture and notch located directly above the ring aperture. The front site includes a bead or substantially circular section to be centered inside the ring and a thinner post style extension located above the bead to interact visually with the notch.

6 Claims, 4 Drawing Sheets

DUAL PICTURE SIGHTS

CROSS-REFERENCE TO RELATED APPLICATIONS

This application is a Non-Provisional of U.S. Provisional Application No. 62/390,387 filed on Mar. 28, 2016. All disclosures of the document named above are incorporated herein by reference.

BACKGROUND OF THE INVENTION

1. Field of the Invention

The invention relates generally to the field of firearms and more specifically to a new design for iron sights, which are shaped, aligned markers used to assist in the aiming of a firearm.

2. Description of the Related Art

Iron sights are well documented in the art. Sights are devices used to assist aligning or aiming firearms. Iron sights are typically composed of two component sights, a rear sight mounted on the rear of the firearm and a front sight mounted forward of the rear sight. Aligning these sights is the normal action of aiming a firearm.

Despite the name "iron sights," the sights may be made of a material other than iron (e.g., steel or another metal or metal alloy, a polymeric material, or a ceramic material).

Iron sights can be categorized into adjustable or fixed sights. Adjustable sights are designed to be adjustable for a variety of conditions (e.g., different ranges, the effect of wind, or varying cartridge bullet weights or propellant loadings), all of which alter the round's velocity and external ballistics and thus its trajectory and point of impact. Fixed sights are not designed to be adjusted and are less fragile.

Iron sights may include colored portions or inserts to aid in quick acquisition. They also may be what is commonly called night sights. Night sights are iron sights with a type of self illumination so that a sight picture may be obtained in low-light situations. The illumination is often achieved using a phosphorescent material, tritium vials or a combination of both. Iron sights may also have non-luminous inserts or other materials, such a fiber optics or brass beads, to change the sight picture.

Current iron sight technology is deficient in several respects. For example, existing iron sights, particularly open sights, do not typically allow the firearm user to align the sights and aim the firearm quickly. On the other hand, aperture sights do not always allow the firearm user to aim the firearm with precision.

There is, therefore, a real need to provide iron sights that allow the firearm user to aim a firearm with both speed and precision. Accordingly, the principal object of the invention is to provide such iron sights and methods of using iron sights that result in both fast and precise aiming of a firearm. Other objects will also be apparent from the detailed description of the invention.

SUMMARY OF THE PRESENT INVENTION

Broadly stated, the objects of the invention are realized, according to one aspect of the invention, by providing iron sights for a firearm that allows the firearm user to align the sights in at least two different ways. This is substantively different than conventional iron sights, which rely on one means to align the sights. Advantageously, this allows the user to focus on aligning the iron sights and aim the firearm for speed, for precision, or for both speed and precision.

According to exemplary embodiments, the present invention embraces a multifunctional sight system for a firearm including a rear sight with a substantially circular aperture connected to a notch located directly above the aperture; and a front sight comprising a substantially circular section (or bead) to be utilized in conjunction with the rear sight's circular aperture and an upper extension located above and smaller than the circular bead section to be utilized in conjunction with the notch at the top of the rear sight. The multifunctional sight system may be installed on the firearm using conventional procedures.

In an embodiment of the invention, the circular aperture on the rear sight appears to be larger than the solid circular section on the front sight when the firearm is sighted in traditional fashion.

In an embodiment of the invention, the notch at the top of the rear sight appears larger than the post at the top of the front sight when the firearm is sighted in a traditional fashion.

The present invention also relates to a method of sighting a target comprising obtaining a firearm with an iron sight system as defined in the embodiment above and superimposing the sights over a target by centering the solid circular bead section of the front sight over the target and simultaneously within the center of the circular aperture of the rear sight.

The method described above may further include the step of superimposing the sights on a target by simultaneously horizontally centering the square post of the forward front sight within the notch of the rear sight while having the top of the front sight post at the same level as the top of the rear sight notches and the center of the top of the forward front sight post appearing to be over the target.

The sights of the invention may be either fixed or adjustable, come in plain black or a variety of colors, optionally may utilize tritium inserts or other luminous substances, and optionally may utilize non-luminous inserts, such as brass beads or fiber optics.

BRIEF DESCRIPTION OF THE DRAWINGS

The invention is more fully described by reference to the following detailed description and the accompanying drawings wherein.

DETAILED DESCRIPTION

Figure 1:
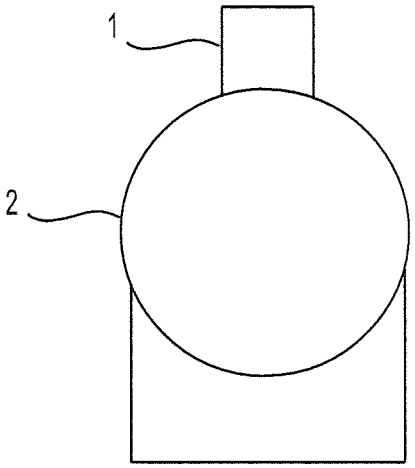
FIG. 1 is a plan view of the front sight.

Referring more specifically to the drawings, FIG. 1 shows the front view of the front sight in accordance with one embodiment of the invention. Contrary to conventional front sights, this embodiment uses a square or rectangular post 1 connected to the top of a larger bead section 2, which is a circular or substantially circular. This bead section 2 may be similar in design to express style sights or bead style sights and is designed for fast acquisition of the front sight.

Figure 2:
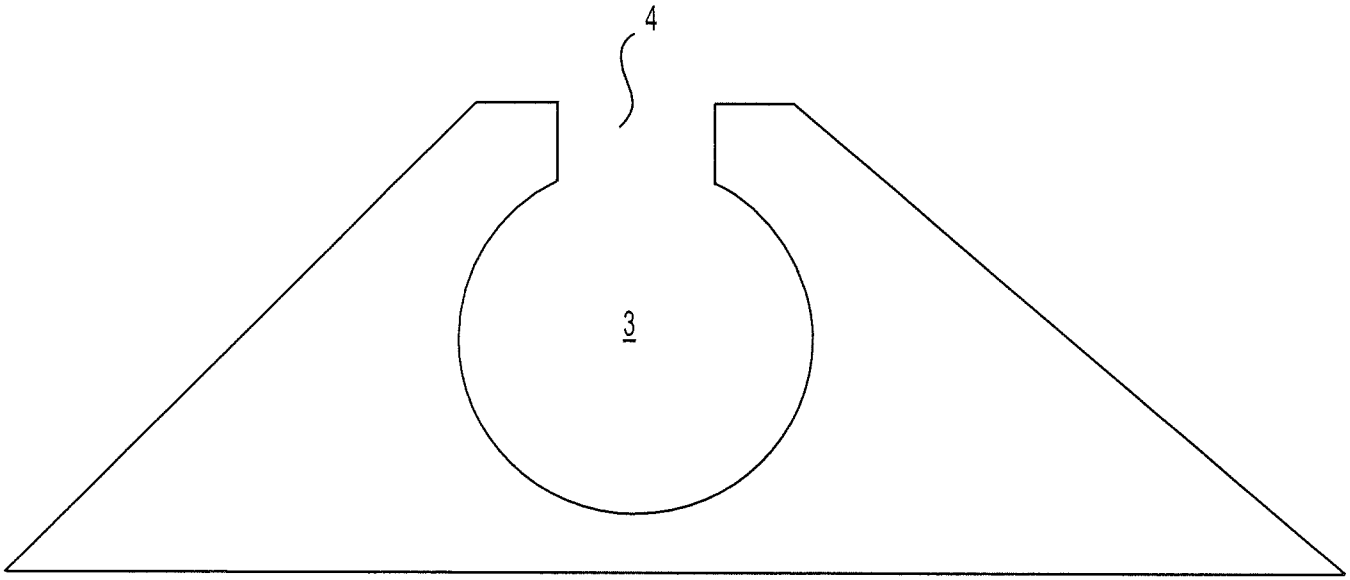
FIG. 2 is a plan view of the rear sight

FIG. 2 shows a front view of the rear sight designed to interact with the front sight shown in FIG. 1. The ring portion 3 is similar in design and in effect to a ghost ring style aperture rear sight, which aids in natural alignment of the sights and in drawing the eye to the front sight. The notch portion 4 is made to visually interact with the square or rectangular post of the front sight 1, allowing a regular notch and post sight picture in addition to the bead and ghost ring.

Figure 3:
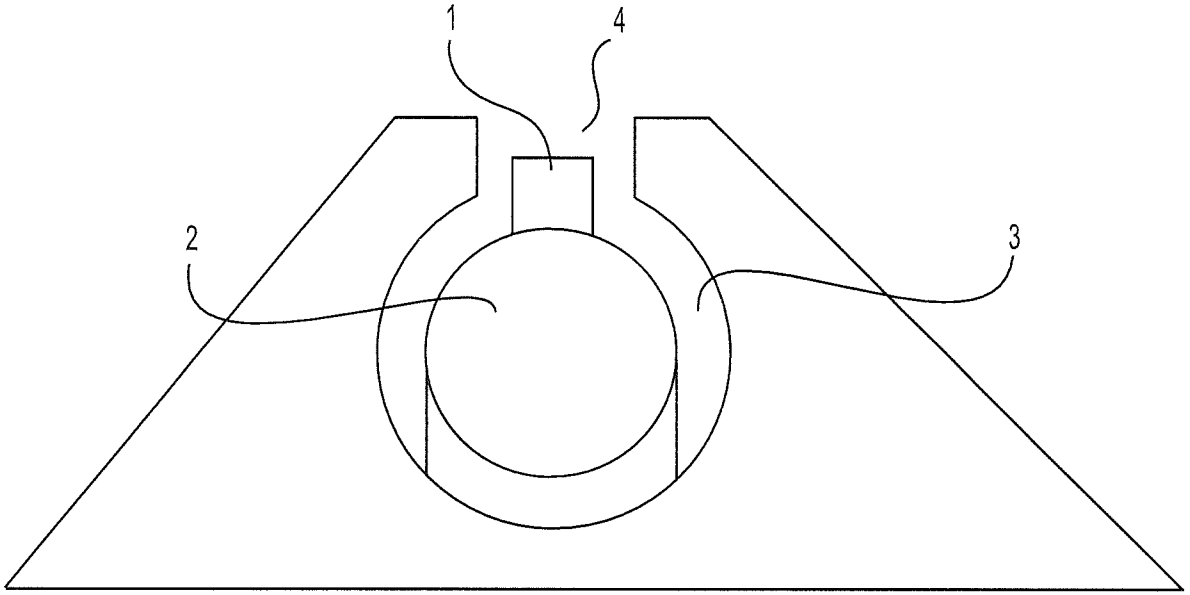
FIG. 3 is a plan view of both the front sight and the rear sight using the aperture and bead for alignment.
Figure 4:
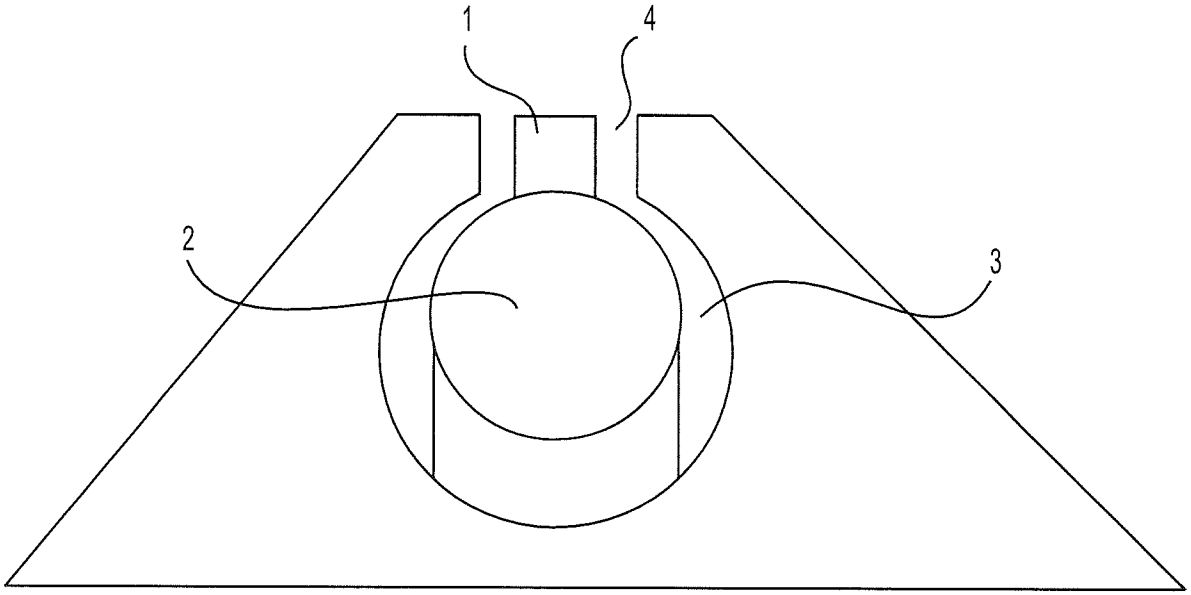
FIG. 4 is a plan view of both the front sight and the rear sight using the notch and post for alignment.

FIG. 3 shows a front view of the front sight and the rear sight, the sight picture utilizing the bead section 2 and the ring aperture of the rear sight 3. The ring aperture 3 helps the firearm user to center the bead section 2 quickly and naturally, as it is instinctive to center the bead section 2 in the ring 3. The size of the bead makes it relatively easy to see with the human eye. This allows for quick acquisition of the front sights and quick, natural sight alignment. When very precise shots are necessary, the upper post of the front sight 1 and the upper notch of the rear sight 4 are used. These offer a notch and post style sight picture. Because the portions of the sight picture that are used for fast acquisition and precise shooting are separate, these sights aid in both fast and precise shooting, depending on the situation, without the need to compromise the sights' potential for one type of shooting over the other.

In embodiments of the invention, the sites may utilize a variety of inserts, colors or luminous material to improve the sight picture.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A multifunctional sight system for a firearm comprising:

a rear sight with a substantially circular aperture having a notch located directly above the aperture; and a front sight comprising a substantially circular bead section to be utilized in conjunction with the rear sight's circular aperture and an upper post extension smaller than the circular bead section to be utilized in conjunction with the notch at the top of the rear sight.

2. The multifunctional sight system of claim 1, wherein the system is installed on the firearm using conventional procedures.

3. The multifunctional sight system of claim 1, wherein the circular aperture on the rear sight appears to be larger than the solid circular bead section of the front sight when the firearm is sighted in traditional fashion.

4. The multifunctional sight system of claim 1, wherein the notch at the top of the rear sight appears larger than the post at the top of the front sight when the firearm is sighted in a traditional fashion.

5. A method of sighting a target comprising:

obtaining a firearm with an iron sight system as defined in claim 1; and superimposing the sights over a target by centering the bead section of the front sight over the target and simultaneously within the center of the circular aperture of the rear sight.

6. A method of sighting a target of claim 5 further comprising superimposing the sights on a target by simultaneously horizontally centering the square post of the forward front sight within the notch of the rear sight while having the top of the front sight post at the same level as the top of the rear sight notches and the center of the top of the forward front sight post appearing to be over the target.

* * * * *